US008613471B2

(12) United States Patent
Heim

(10) Patent No.: US 8,613,471 B2
(45) Date of Patent: Dec. 24, 2013

(54) SECURITY ELEMENT AND METHOD FOR THE PRODUCTION THEREOF

(75) Inventor: Manfred Heim, Bad Tolz (DE)

(73) Assignee: Giesecke & Devrient GmbH, Munich (DE)

( * ) Notice: Subject to any disclaimer, the term of this patent is extended or adjusted under 35 U.S.C. 154(b) by 252 days.

(21) Appl. No.: 12/809,002

(22) PCT Filed: Dec. 17, 2008

(86) PCT No.: PCT/EP2008/010740
§ 371 (c)(1),
(2), (4) Date: Jun. 17, 2010

(87) PCT Pub. No.: WO2009/080262
PCT Pub. Date: Jul. 2, 2009

(65) Prior Publication Data

US 2011/0079997 A1 Apr. 7, 2011

(30) Foreign Application Priority Data

Dec. 20, 2007 (DE) ..... 10 2007 061 827

(51) Int. Cl.
*B42D 15/00* (2006.01)

(52) U.S. Cl.
USPC ..... 283/72; 283/85; 283/91

(58) Field of Classification Search
USPC ..... 283/72, 85, 91
See application file for complete search history.

(56) References Cited

U.S. PATENT DOCUMENTS 3,858,977 A 1/1975 Baird et al.
4,659,112 A * 4/1987 Reiner et al. ..... 283/90
5,331,443 A 7/1994 Stanisci
6,024,455 A * 2/2000 O'Neill et al. ..... 359/530
6,761,959 B1 7/2004 Bonkowski et al.
6,987,590 B2 1/2006 Phillips et al.
7,029,745 B2 4/2006 Bonkowski et al.
7,667,894 B2 2/2010 Hoffmuller
7,728,931 B2 6/2010 Hoffmuller (Continued)

FOREIGN PATENT DOCUMENTS

CN 1976816 A 6/2007
DE 102004039355 A1 2/2006

(Continued)

OTHER PUBLICATIONS

International Search Report, International Application No. PCT/EP2008/010742, 2 pages, Jul. 10, 2009.
International Preliminary Report on Patentability, International Application No. PCT/EP2008/010742, 6 pages, Aug. 3, 2010, English Translation.
International Search Report, International Application No. PCT/EP2008/010740, 3 pages, Apr. 23, 2009.

(Continued)

*Primary Examiner* — Kyle Grabowski
(74) *Attorney, Agent, or Firm* — Lathrop & Gage LLP

(57) ABSTRACT

The invention relates to a security element (22) for securing items of value, with a relief structure (22) on which a thin film element (24) having a color shift effect is superposed in an overlap zone, wherein the thin film element (24) includes an absorber layer (30) with gaps (32), in the zone of which a color shift effect is not visible, and with a semitransparent ink layer (34), which is superposed on the thin film element (24) and the relief structure (22) in the area of the gaps (32) in the absorber layer (30), wherein the color impression of the thin film element (24) is coordinated with at least a partial zone of the semitransparent ink layer (34) when viewed under predefined viewing conditions.

26 Claims, 4 Drawing Sheets

(56) References Cited

U.S. PATENT DOCUMENTS

Figure 1:
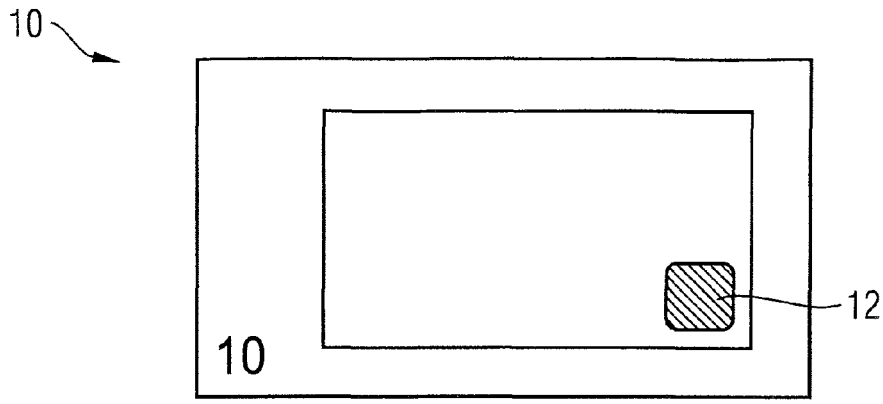

| | | | | |
|---|---|---|---|---|
| 7,808,605 | B2 | 10/2010 | Hoffmuller | |
| 7,986,459 | B2 | 7/2011 | Kaule | |
| 8,083,894 | B2 | 12/2011 | Gruszczynski | |
| 8,149,511 | B2 | 4/2012 | Kaule | |
| 2005/0128543 | A1 | 6/2005 | Phillips et al. | |
| 2005/0141094 | A1 | 6/2005 | Wild et al. | |
| 2005/0168723 | A1 | 8/2005 | Schilling et al. | |
| 2006/0077496 | A1 | 4/2006 | Argoitia et al. | |
| 2007/0165182 | A1 | 7/2007 | Hoffmuller et al. | |
| 2007/0211238 | A1 | 9/2007 | Hoffmuller | |
| 2007/0241553 | A1* | 10/2007 | Heim et al. | 283/91 |
| 2007/0246933 | A1* | 10/2007 | Heim et al. | 283/98 |
| 2007/0273142 | A1 | 11/2007 | Tompkin et al. | |
| 2007/0274559 | A1 | 11/2007 | Depta | |
| 2008/0014378 | A1 | 1/2008 | Hoffmuller | |
| 2008/0054621 | A1 | 3/2008 | Burchard | |
| 2008/0079257 | A1 | 4/2008 | Fessl | |
| 2008/0088859 | A1 | 4/2008 | Depta | |
| 2008/0160226 | A1 | 7/2008 | Kaule | |
| 2008/0163994 | A1 | 7/2008 | Hoppe | |
| 2008/0216976 | A1 | 9/2008 | Ruck | |
| 2008/0250954 | A1 | 10/2008 | Depta | |
| 2008/0258456 | A1 | 10/2008 | Rahm | |
| 2009/0001709 | A1 | 1/2009 | Kretschmar | |
| 2009/0008926 | A1 | 1/2009 | Depta | |
| 2009/0102605 | A1 | 4/2009 | Kaule | |
| 2009/0115185 | A1 | 5/2009 | Hoffmuller | |
| 2009/0297805 | A1 | 12/2009 | Dichtl | |
| 2009/0322071 | A1 | 12/2009 | Dichtl | |
| 2010/0175843 | A1 | 7/2010 | Gregarek | |
| 2010/0177094 | A1 | 7/2010 | Kaule | |
| 2010/0182221 | A1 | 7/2010 | Kaule | |
| 2010/0194091 | A1 | 8/2010 | Heim | |
| 2010/0194532 | A1 | 8/2010 | Kaule | |
| 2010/0196587 | A1 | 8/2010 | Keller | |
| 2010/0207376 | A1 | 8/2010 | Heim | |
| 2010/0208036 | A1 | 8/2010 | Kaule | |
| 2010/0231846 | A1* | 9/2010 | Commander et al. | 283/72 |
| 2010/0307705 | A1 | 12/2010 | Rahm | |
| 2010/0308570 | A1 | 12/2010 | Heim | |
| 2010/0320742 | A1 | 12/2010 | Hoffmuller | |
| 2011/0012337 | A1 | 1/2011 | Heim | |
| 2011/0027538 | A1 | 2/2011 | Hoffmann | |
| 2011/0045248 | A1 | 2/2011 | Hoffmuller | |
| 2011/0069360 | A1 | 3/2011 | Dichtl | |
| 2011/0079997 | A1 | 4/2011 | Heim | |
| 2011/0091665 | A1 | 4/2011 | Heim | |
| 2011/0095518 | A1 | 4/2011 | Hoffmuller | |
| 2011/0101670 | A1 | 5/2011 | Heim | |
| 2011/0109078 | A1 | 5/2011 | Hoffmuller | |
| 2011/0114733 | A1 | 5/2011 | Heim | |
| 2011/0157183 | A1 | 6/2011 | Kaule | |
| 2012/0126525 | A1 | 5/2012 | Dorfler | |
| 2012/0168515 | A1 | 7/2012 | Schutzmann | |
| 2012/0170124 | A1 | 7/2012 | Fuhse | |

FOREIGN PATENT DOCUMENTS

| | | | |
|---|---|---|---|
| DE | 102004051919 | A1 | 4/2006 |
| DE | 102006015023 | A1 | 10/2007 |
| EP | 1 003 126 | A2 | 5/2000 |
| EP | 1 203 968 | A1 | 5/2002 |
| EP | 1 047 549 | B1 | 3/2003 |
| EP | 0 733 919 | B1 | 9/2003 |
| EP | 0 911 758 | B1 | 11/2005 |
| EP | 1 628 147 | A1 | 2/2006 |
| EP | 1 715 392 | A1 | 10/2006 |
| EP | 1 503 907 | B1 | 1/2007 |
| JP | 2003326876 | A | 11/2003 |
| JP | 2008083599 | A | 4/2008 |
| WO | WO 01/03945 | A1 | 1/2001 |
| WO | WO 01/53113 | A1 | 7/2001 |
| WO | WO 02/00445 | A1 | 1/2002 |
| WO | WO 02/00446 | A1 | 1/2002 |
| WO | WO 03/095228 | A1 | 11/2003 |
| WO | WO 03/095657 | A2 | 11/2003 |
| WO | WO 2005/038136 | A1 | 4/2005 |
| WO | WO 2005/105474 | A2 | 11/2005 |
| WO | WO 2005/105475 | A1 | 11/2005 |
| WO | WO 2005/108108 | A2 | 11/2005 |
| WO | WO 2005105473 | | 11/2005 |
| WO | WO 2005105474 | | 11/2005 |
| WO | WO 2005105475 | | 11/2005 |
| WO | WO 2005108106 | | 11/2005 |
| WO | WO 2005108108 | | 11/2005 |
| WO | WO 2005108110 | | 11/2005 |
| WO | WO 2006005434 | | 1/2006 |
| WO | WO 2006015733 | | 2/2006 |
| WO | WO 2006018171 | | 2/2006 |
| WO | WO 2006018171 | A2 * | 2/2006 |
| WO | WO 2006018172 | | 2/2006 |
| WO | WO 2006/040069 | A1 | 4/2006 |
| WO | WO 2006040069 | | 4/2006 |
| WO | WO 2006040069 | A1 * | 4/2006 |
| WO | WO 2006056342 | | 6/2006 |
| WO | WO 2006072380 | | 7/2006 |
| WO | WO 2006087138 | | 8/2006 |
| WO | WO 2006099971 | | 9/2006 |
| WO | WO 2006119896 | | 11/2006 |
| WO | WO 2006128607 | | 12/2006 |
| WO | WO 2007006445 | | 1/2007 |
| WO | WO 2007006455 | | 1/2007 |
| WO | WO 2007/051529 | A1 | 5/2007 |
| WO | WO 2007076952 | | 7/2007 |
| WO | WO 2007079851 | | 7/2007 |
| WO | WO 2007115648 | | 10/2007 |
| WO | WO 2007/138293 | A2 | 12/2007 |
| WO | WO 2008/000350 | | 1/2008 |
| WO | WO 2008/000351 | | 1/2008 |
| WO | WO 2008/049533 | | 5/2008 |
| WO | WO 2008/061636 | | 5/2008 |
| WO | WO 2008/071325 | | 6/2008 |
| WO | WO 2009/000527 | | 12/2008 |
| WO | WO 2009/000528 | | 12/2008 |
| WO | WO 2009/000529 | | 12/2008 |
| WO | WO 2009/000530 | | 12/2008 |
| WO | WO 2009/012893 | | 1/2009 |
| WO | WO 2009/024265 | | 2/2009 |
| WO | WO 2009/080262 | | 7/2009 |
| WO | WO 2009/080263 | | 7/2009 |
| WO | WO 2009/083146 | | 7/2009 |
| WO | WO 2009/083151 | | 7/2009 |
| WO | WO 2009/100831 | | 8/2009 |
| WO | WO 2009/100869 | | 8/2009 |
| WO | WO 2009/109291 | | 9/2009 |
| WO | WO 2009/121578 | | 10/2009 |
| WO | WO 2009/149831 | | 12/2009 |
| WO | WO 2009/149833 | | 12/2009 |
| WO | WO 2009/156079 | | 12/2009 |
| WO | WO 2010/000470 | | 1/2010 |
| WO | WO 2010/003646 | | 1/2010 |
| WO | WO 2010/028739 | | 3/2010 |
| WO | WO 2011/012281 | | 2/2011 |
| WO | WO 2011/032665 | | 3/2011 |
| WO | WO 2011/032671 | | 3/2011 |

OTHER PUBLICATIONS

International Preliminary Report on Patentability, International Application No. PCT/EP2008/010740, 6 pages, Nov. 22, 2010, English Translation.

International Search Report, International Application No. PCT/EP2009/000686, 2 pages, Sep. 18, 2009.

International Preliminary Report on Patentability, International Application No. PCT/EP2009/000686, 6 pages, Sep. 7, 2010, English Translation.

International Search Report, International Application No. PCT/EP2009/001094, 2 pages, Jul. 10, 2009.

International Preliminary Report on Patentability, International Application No. PCT/EP2009/001094, 9 pages, Nov. 2, 2010.

* cited by examiner

SECURITY ELEMENT AND METHOD FOR THE PRODUCTION THEREOF

CROSS-REFERENCE TO RELATED APPLICATIONS

This application is the U.S. National Stage of International Application No. PCT/EP2008/010740, filed Dec. 17, 2008, which claims the benefit of German Patent Application DE 10 2007 061 827.3, filed Dec. 20, 2007, both of which are hereby incorporated by reference to the extent not inconsistent with the disclosure herewith.

The invention relates to a security element for securing items of value, a method for producing such a security element, and to a security paper and a data carrier having such a security element.

For protection, data carriers such as value or identity documents, but also other objects of value, such as branded articles, are often provided with security elements that enable the authenticity of the data carrier to be verified and at the same time serve as protection against illicit reproduction. Security elements of such kind may for example have the form of a security thread embedded in a banknote, a covering foil for a banknote having a hole, an applied security strip, a self-supporting transfer element, or it may even be designed as a feature area applied directly to a value document.

Security elements displaying visual effects that change according to the angle at which they are viewed, are particularly important for safeguarding against forgery, because these cannot be reproduced even with the most modern copiers. For this purpose, the security elements are provided with optically variable elements, which present the viewer with a different image impression, and for example a different color or brightness impression and/or motif when they are viewed from different angles.

In this context, it is known to use security elements having multilayer thin film elements, which present the viewer with a different color impression depending on the angle from which they are viewed, such that the security feature changes color for example from green to blue, from blue to magenta, or from magenta to green when it is tilted. These changes in color that take place when the security element is tilted are referred to in the following as the color shift effect.

Based on that, the object of the invention is to further improve a security element of the kind described in the introduction, and particularly to provide a security element with an attractive visual appearance and high counterfeit security.

This object is solved by the security element having the features of the main claim. A method for producing such a security element, a security paper, and a data carrier are described in the coordinate claims. Developments of the invention are the subject of the dependent claims.

According to the invention, a security element of the type described in the introduction includes

- a relief structure on which a thin film element having a color shift effect is disposed in an overlap area, wherein the thin film element comprises an absorber layer with gaps, in the area of which no color shift effect is perceptible, and
- a semitransparent ink layer, which is disposed on top of the thin film element and the relief structure in the area of the gaps in the absorber layer, wherein the color impression of the thin film element is coordinated with at least one subzone of the semitransparent ink layer when viewed under predefined viewing conditions.

In the context of the invention, a relief structure, particularly a microrelief structure of a type described in greater detail in the following, is combined with two different color zones that appear very similar when viewed from a certain viewing direction, but behave differently when the security element is tilted: in the zones that are not covered by the semitransparent ink layer, the color impression of the relief structure for the viewer changes when the security element is tilted, whereas the gap areas that are covered, do not change color.

Such a combination of color-constant and color-variable relief structure zones has an attractive visual effect and is self-explanatory for the user, since the color-constant zones function as a visual reference and point of comparison with the color-variable zones during authentication. The combination of two color effects immediately adjacent one another makes it very difficult to recreate the security element, since freely available colors or foils with color shift effects can no longer be used without modification.

It is within the scope of the invention for the thin film element to be disposed over part or over all of the relief structure, or to extend beyond it.

In a preferred variant of the invention, the semitransparent ink layer fills in the area of the gaps in the absorber layer completely. In this case, color-constant and color variable zones complement each other to create the complete image impression of the security element.

In another, also advantageous variant of the invention, the semitransparent ink layer only fills the area of the gaps in the absorber layer partially, not completely. Thus, besides the color-variable and color-variable zones, a further type of relief zones is created, which has a metallic appearance because its visual impression is characterized by the reflection layer of the thin film element. This feature allows even greater freedom in the design options that may be used to create the security elements.

According to a refinement of the invention, the semitransparent ink layer is also present in areas of the absorber layer above the thin film element where no gaps are present. When tilted, such areas remain largely, though usually not entirely, color-constant. Their use is particularly advantageous in cases where intricate characters or patterns in color-constant relief zones are to be surrounded by color-variable relief zones, where it is often difficult to create precisely matching gaps in the absorber layer below extremely small ink layer zones. Particularly in small structures and adjacent zones that exhibit a marked color change when tilted, the slightly reduced color constancy is practically imperceptible to the viewer.

The semitransparent ink layer preferably has a light transmissivity between 30% and 95%, particularly preferably between 60% and 95%, and especially preferably between 80% and 95% in a spectral range in which the color impression of the thin film element is coordinated with the color impression of the semitransparent layer.

The semitransparent ink layer may be applied in various ways, advantageously it is imprinted, for example in a silk-screen, intaglio, flexographic, or other suitable printing process. In this context, the semitransparent ink layer may be printed directly onto the thin film element, though transparent intermediate layers may also be provided between the ink layer and the thin film element, functioning as a protective or adhesive layer, for example. Such transparent intermediate layers may also be provided between the ink layer and the phase delay layer.

In order to enable additional features to be introduced into the security element, the gaps in the absorber layer and/or the semitransparent ink layer are preferably present in the form of characters, patterns or codes. In this way, designs are also included in which the ink layer has gaps in the form of characters, patterns or codes. The characters, patterns or codes of the gaps and the ink layer may correspond to each other exactly, for example when the ink layer completely fills the gaps in the absorber layer. In general, however, the respective characters, patterns or codes may also differ, such as when the ink layer only partially fills the gaps or is also present in zones where there are no gaps.

The semitransparent ink layer may also include multiple subzones with different color impressions, in which case the color impression of the thin film element when viewed under predefined viewing conditions is coordinated with the color impression of at least one of the subzones.

A particularly appealing effect may be achieved if the thin film element and the semitransparent ink layer are harmonized with each other in such way that when the security element is viewed perpendicularly the color impression of the thin film element outside the covered zones essentially matches the color impression of at least one subzone of the semitransparent ink layer. When viewed perpendicularly, which is often the way a security element applied to a value item is seen initially, the color-variable and the color-constant zones then convey essentially the same color impression at first glance. When the security element is tilted, the color impression in the color-variable zones changes, while the color impression in the color-constant, covered zones, remains unchanged.

In an advantageous embodiment of the invention, the thin film element is provided with a reflection layer, an absorber layer, and a dielectric spacer layer disposed between the reflection layer and the absorber layer. The color shift effect in such thin film elements is based on viewing angle dependent interference effects arising from interference of the light beams reflected on various sublayers of the element. The path difference of the light reflected at the various layers is determined on the one hand by the optical thickness of the dielectric spacer layer, which determines the distance between the absorber layer and the reflection layer, and it also varies according to the viewing angle.

Since the path difference is of the order of magnitude of the wavelength of visible light, the color impression varies for the viewer according to angle as certain wavelengths are cancelled and others amplified. By suitable selection of material and thickness of the dielectric spacer layer, it is possible to create a wide range of different color shift effects, for example tilt effects in which the color impression changes from green to blue, from blue to magenta, or from magenta to green depending on the viewing angle.

The reflection layer of the thin film element is preferably formed by an opaque or semitransparent metallic layer, particularly of aluminum. A layer of which at least partial areas are magnetic may also be used as the reflection layer, thus enabling a further authentication feature to be integrated without the need for an additional layer in the layer construction.

The reflection layer may include further gaps in the shape of patterns, characters or codes, which form transparent or semitransparent zones in the thin film element. The viewer perceives a marked contrast with the surrounding color effects in the transparent or semitransparent gap zones. In particular, the patterns, characters or codes may shine brightly in transmitted light when the thin film element and the relief structure are applied to a transparent or translucent substrate. The gaps in the reflection layer may also be arranged in the manner of a grid, preferably with a small area fraction of 40% or less, so that they are practically unnoticeable in incident light, and only appear clearly in transmitted light.

According to another, also advantageous variant of the invention, the thin film element may also be formed by superposed absorber layers and dielectric spacer layers, wherein multiple absorber and spacer layers may also be arranged one on top of the other alternatingly. Thin film elements of such kind also present a color shift effect, but are not opaque, so the color shift effect is also visible from the rear of the security element.

In all configurations, the dielectric spacer layer is preferably created in a vacuum vapor deposition process. Alternatively, the spacer layer may also be formed by a printed layer or an ultrathin film, particularly a drawn polyester film. Currently, a construction in which the dielectric spacer layer is formed by a low refractive dielectric layer, particularly a vapor-deposited $SiO_2$ layer or an $MgF_2$ layer, is preferred.

Further details regarding the structure of such thin film elements and the materials and layer thicknesses that are usable for the reflection layer, the dielectric spacer layer and the absorber layer are included in patent specification WO 01/03945, the disclosure of which in this respect is included in the present application.

The relief structure may form a diffractive structure, such as a hologram, a holographic grating image, or a hologram-like diffraction structure, or also an achromatic structure such as a matte structure with an uncolored, typically silvery matt appearance, a micromirror arrangement, a blazed grating with a sawtooth-like notched profile or a Fresnel lens arrangement. The dimensions of the structural elements in the diffractive relief structures are mostly in the magnitude of light wavelength, that is to say typically between 300 nm and 1 μm. Some relief structures also include smaller structure elements such as subwavelength gratings or moth-eye structures, the structure elements of which may even be smaller than 100 nm. Some structure elements of achromatic relief structures are also larger than 1 μm, the dimensions of micromirrors or blazed grating lines may reach a height of about 15 μm and a lateral extension of about 30 μm. Relief structures with structure elements having a dimension less than 30 μm, and particularly relief structures with structure elements in the magnitude of light wavelength or less are referred to as microrelief structures for the purposes of this description.

In an advantageous refinement of the invention, a transparent phase delay layer is arranged in areas over the thin film element, forming a phase-delaying layer for light in the visible wavelength range. Phase-delaying layers, which are sometimes also referred to as phase-shifting layers in this description, are optically active layers that influence the phase of a transmitted light wave. As a result of the different refractive indices the partial light beams of an incident polarized light wave undergo optical retardation and thus receive a phase difference. If the phase difference between the two partial beams is just one half or one quarter of the wavelength, so called $\lambda/2$ or $\lambda/4$ layers are formed.

The phase delay of the phase delay layer in the invention preferably corresponds to an optical retardation between about $\lambda/6$ and about $\lambda/2$, particularly between about $\lambda/4$ and about $\lambda/2$. The optical retardation is specified modulo $\lambda$, that is to say in the range between 0 and $\lambda$, because a layer with a phase retardation of, for example $5/4*\lambda$ or $9/4*\lambda$ causes the same phase delay as a $\lambda/4$ layer. Within the present invention, it is further preferred that the phase shifting layer is formed from nematic liquid crystal material and/or that the phase delay layer is provided in the form of patterns, characters or a code.

In particularly preferred configurations, the semitransparent ink layer is selected such that it essentially preserves the polarization state of penetrating light from the visible wavelength range. In this way, the patterns, characters or codes formed by the phase delay layer may be rendered equally visible in both the color-variable and the color-constant zones.

The security element is preferably provided on a substrate, which may be formed by a plastic film. After the security element has been transferred to a data carrier, the substrate may be detached from the layer structure of the security element, or it may be left as a permanent component of the security element in the layer structure as a protective layer. In some configurations, a releasing or separating layer, for example a wax, may also be provided between the security element and the substrate.

The security element is preferably a security thread, a security tape, a security strip, a patch or a label that may be attached to a security paper, value document or similar.

Of course, the security element may also include additional layers, such as protective layers or additional effect layers with different security features, for example.

The invention also relates to a method for producing a security element of the type described, in which

- an embossing lacquer layer is applied to a substrate and embossed in the form of a desired relief structure,
- in an overlap area, a thin film element having a color shift effect is disposed on the relief structure, wherein an absorber layer of the thin film element is provided with gaps, in the area of which no color shift effect is perceptible, and
- a semitransparent ink layer is disposed on top of the thin film element and the relief structure in the area of the gaps in the absorber layer, wherein the color impression of the thin film element is coordinated with the color impression of at least a subzone of the semitransparent ink layer when viewed under predefined conditions.

A transparent phase delay layer is preferably arranged in areas over the thin film element and forms a phase shifting layer for light in the visible wavelength range.

In the method according to the invention, the semitransparent ink layer is advantageously printed, particularly in a silk-screen, intaglio or flexographic printing process. The phase delay layer may advantageously be printed onto the thin film element and the ink layer applied beforehand as well, if applicable. Alternatively, the phase delay layer may be applied to a separate carrier foil and transferred to the thin film element having the applied ink layer.

The invention further includes a security paper having a security element of the type described, and a data carrier that is equipped with such a security element. The data carrier may particularly be a banknote, a value document, a passport, a certificate or an identity card. The security elements, security papers or data carriers described may particularly be used to protect objects of any kind against forgery.

Further embodiments and advantages of the invention will be explained in the following with reference to the drawing, in which, for the sake of clarity, the elements are not drawn to a uniform scale or proportion.

Figure 2:
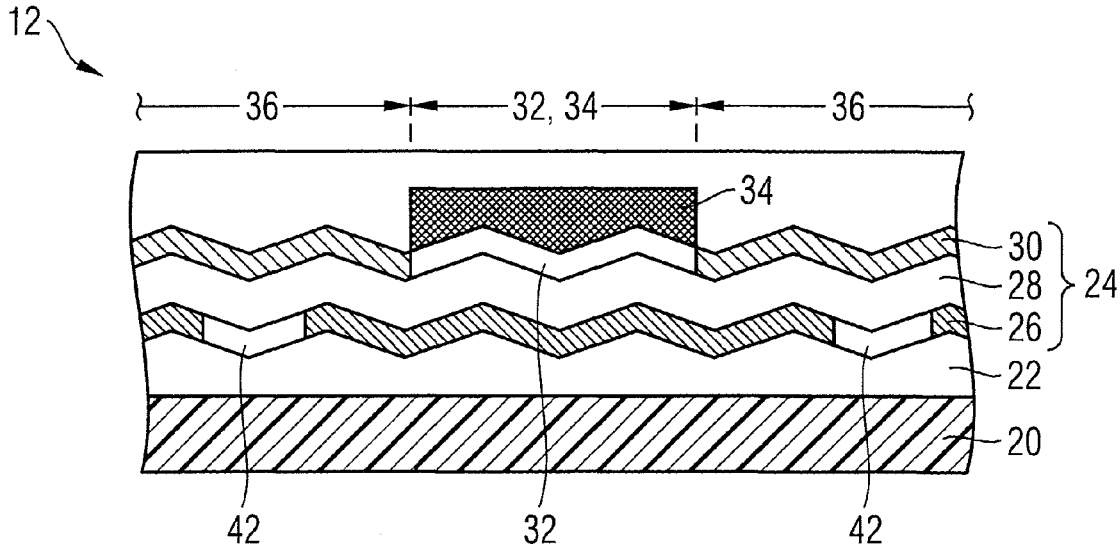
Figure 3A:
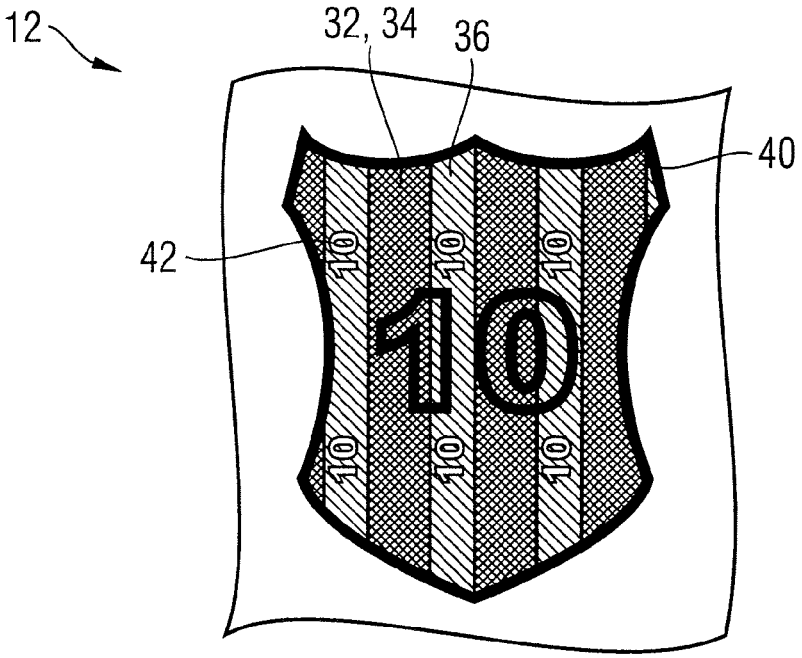
Figure 3B:
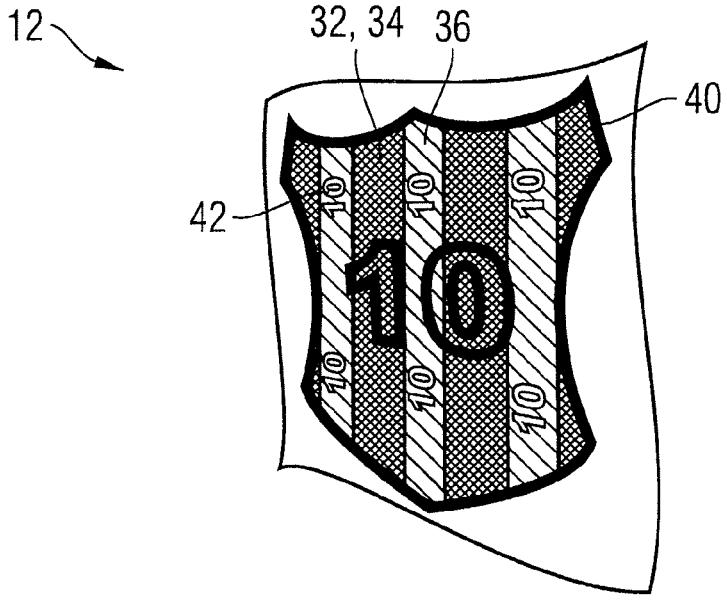
Figure 4:
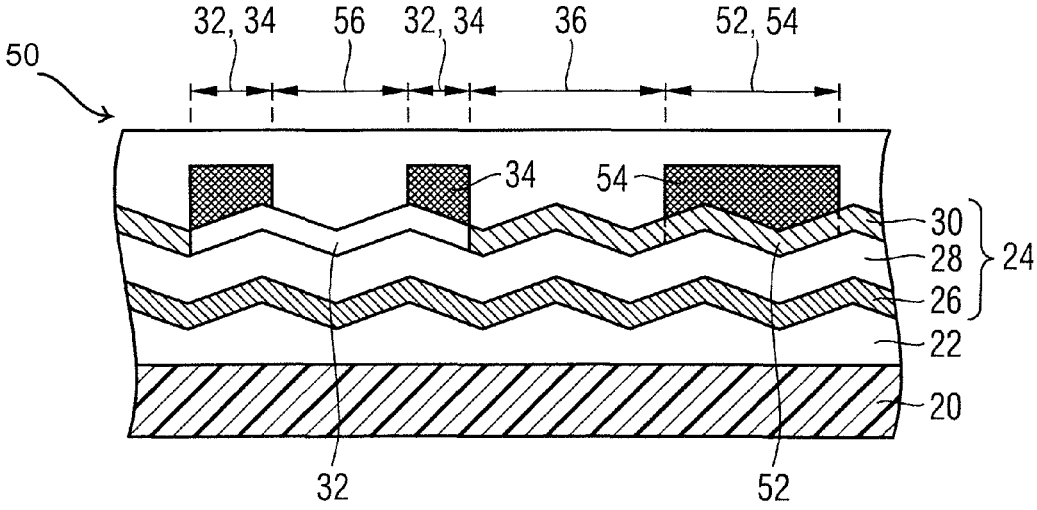
Figure 5:
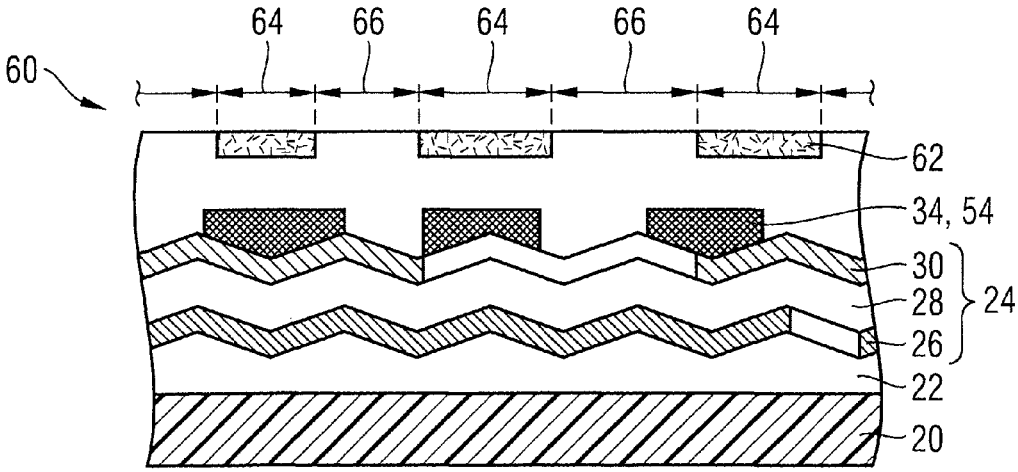
Figure 6:
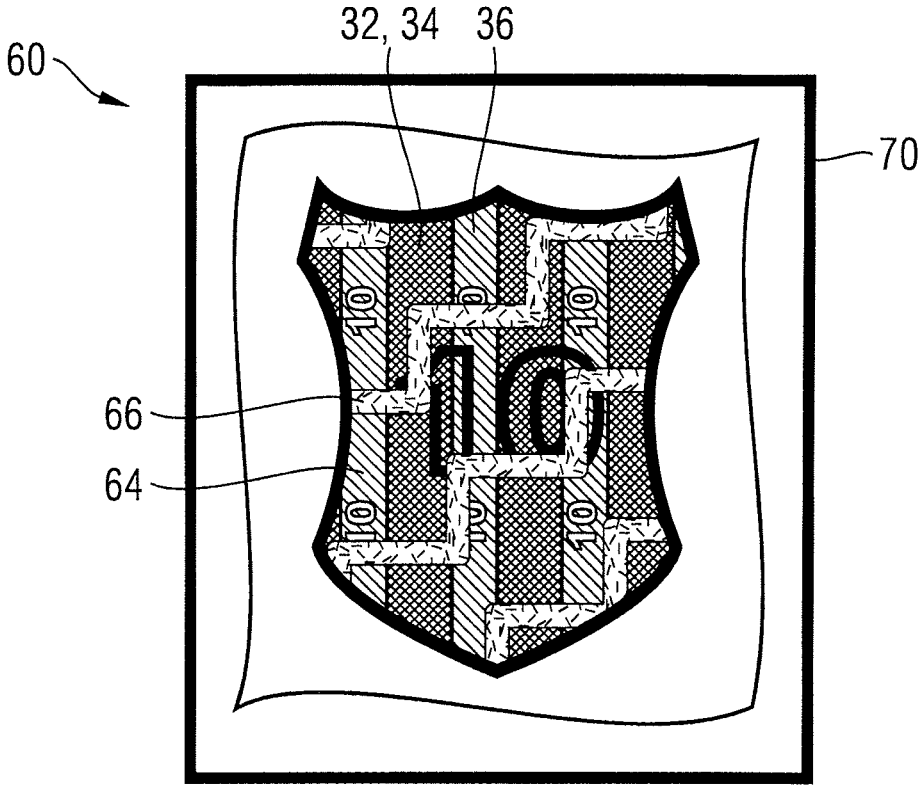

In the drawings:

FIG. 1 is a schematic representation of a banknote having a security element according to the invention, FIG. 2 is a cross section through a security element according to an embodiment of the invention, FIG. 3 is a schematic representation of the visual impression of a security element according to the invention, (a) when it is viewed perpendicularly and (b) when it is viewed at an angle, with the unaided eye in each case, FIG. 4 is a cross section through a security element according to a different embodiment of the invention, in which the semitransparent ink layer only partially fills the area of the gaps in the absorber layer, FIG. 5 shows a color shift hologram according to a further embodiment of the invention, in which the color-constant and the color-variable zones are combined with a hidden security feature, and FIG. 6 shows the visual impression of the security element of FIG. 5 when it is viewed perpendicularly with a circular polarizer placed on top of it.

The invention will now be described using the example of a banknote. For this purpose, FIG. 1 shows a schematic representation of a banknote 10 having a security element 12 according to the invention in the form of an adhesively attached transfer element. Of course, the invention is not limited to transfer elements and banknotes, but may be used on all types of security elements, for example on labels on goods an packages, or on the protection of documents, identity cards, passports, credit cards, health cards and the like. On banknotes and similar documents security threads for example may be used as well as transfer elements, and besides top view elements, also see-through elements.

The structure of a security element 12 according to the invention will now be explained in greater detail with reference to FIGS. 2 and 3, wherein FIG. 2 shows a cross-section through the security element and FIG. 3 shows the visual impression of the security element when viewed from different directions, represented schematically in (a) and (b).

With reference first to FIG. 2, security element 12 includes a carrier foil 20 and a UV lacquer layer 22 that has been applied on top of carrier foil 20, embossed and cured. The embossing structures of lacquer layer 22 form a diffractive relief structure in the form of a hologram. In other configurations, the embossed structures may also represent a holographic grating image, a hologram-like diffraction structure, or also an achromatic microstructure with an uncolored, for example silvery matt appearance.

A thin film element 24 having a color shift effect and consisting of a reflection layer 26 having an opaque aluminum layer, a dielectric $SiO_2$ spacer layer 28 that has been vapor deposited on reflection layer 26, and a semitransparent absorber layer 30 of chrome, is applied to the relief structure of lacquer layer 22. As was explained earlier, the color shift effect of such a thin film element 24 is based on interference effects caused by multiple reflections in sublayers 26, 28, 30 of the element.

According to the invention, absorber layer 30 is provided with gaps 32, and the thin film element 24 has no color shift effect in the area of these gaps because there is no interference. Security element 12 further contains a semitransparent ink layer 34, which is arranged over thin film element 24 and the relief structure in the area of gaps 32 in absorber layer 30. In the embodiment shown in FIG. 2, semitransparent ink layer 34 completely fills gap areas 32 in the absorber layer. In the areas 36 outside of gap areas 32, there is no printed ink layer on thin film element 24. In the idealized representation of FIG. 2, ink layer 34 ends in register with gaps 32 in the absorber layer. In practice, ink layer 34 may of course overlap the absorber slightly, or the area of the absorber that is not cut out may extend slightly into ink layer zones 34.

According to the invention, thin film element 24 and semitransparent ink layer 34 are matched in such manner that when viewed perpendicularly, they provide essentially the same color impression.

When security element 12 is tilted, the color impression of thin film element 24 changes in uncovered zones 36 due to the color shift effect occurring there, whereas the color impression does not change with tilting in first zones 32, 34, which are covered by the ink layer. For example, thin film element 24 may be designed such that a color impression of magenta when viewed perpendicularly changes to green when viewed at an angle. Matching this, semitransparent ink layer 34 also conveys a magenta color impression when viewed perpendicularly, but unlike the color impression of thin film element 24, this remains unchanged when security element 12 is tilted.

Overall, security element 12 thus shows the viewer a hologram motif 40 having two color zones, which behave differently when the security element is tilted. As indicated in FIG. 3(*a*) by the similarly hatched areas, the color impressions of covered zones 32, 34 and uncovered zones 36 are very similar or even identical, when viewed perpendicularly. When security element 12 is tilted, the color impression of uncovered zones 36 changes from magenta to green progressively as the tilt angle increases, while the color impression in the zones covered by ink layer 34 remains magenta, unchanged.

As shown in FIG. 3(*b*), the viewer thus perceives a clear difference between the colors in zones 32, 34 and zones 36 when viewing at an angle, as is indicated in the figure by the dissimilar hatched areas. This combination of color-variable zones 36 and immediately adjacent color-constant zones 32, 34 further enhances the visual perception of the color shift effect, since the human eye responds more intensely to the color differences it perceives than to the change in color itself.

In preferred designs, gaps 42 may also be introduced into reflection layer 26 of thin film element 24, forming a negative text for example. In the area of these gaps 42, thin film element 24 is transparent or translucent, thus creating a clearly striking contrast effect in transmitted light in addition to the effects described above. In this context, the term translucence is used to refer to a certain degree of light transmissivity, wherein translucent layers usually reduce the brightness of the objects located behind or below them and/or alter their color.

The structure of security element 50 shown in FIG. 4 is largely the same as that of security element 12 in FIGS. 2 and 3. However, unlike the configuration described previously, in security element 50 semitransparent ink layer 34 only partially fills the area of gaps 32 in absorber layer 30 of thin film element 24, not completely.

As a result, besides color shifting zone 36 and color-constant zone 32, 34, a further hologram zone 56 is created in which the visual impression of security element 50 is determined by aluminum reflection layer 26, so that the hologram appears silvery-metallic there. This measure further increases the variety of possible combinations and the configuration options for the designer.

In some configurations, it may also be advantageous if semitransparent ink layer 54 is also present in areas 52 of absorber layer 30 where there are no gaps. When viewed perpendicularly, such areas 52, 54 present essentially the same color impression as covered zones 32, 34 and uncovered zones 36. Unlike the entirely color-constant zones 32, 34, the color impression of zones 52, 54 changes slightly when security element 50 is tilted, because the changing shift color of thin film element 24 is slightly visible through semitransparent ink layer 34, the degree depending on its light transmissivity.

The use of such largely color-constant zones 52, 54 may be particularly advantageous if fine characters or patterns as color-constant relief zones are to be surrounded by color-variable relief zones. In this case, it is often difficult, if not impossible, to create gaps in absorber layer 30 below and in register with the very small ink layer zones 54. Although the mainly color-constant zones 52, 54 have slightly less color constancy than the fully color-constant zones 32, 34 when tilted, this is practically imperceptible to the viewer, particularly in the case of small structures and in comparison to the adjacent zones 36, which show a marked color shift on tilting.

FIGS. 5 and 6 show a color shift hologram as a further embodiment of the invention, in which the visual effects described previously are combined with a hidden security feature. Besides the elements that were described with reference to FIGS. 2 to 4, security element 60 of FIG. 5 is provided with a transparent phase delay layer 62 in the form of a pattern disposed in areas 64 over thin film element 24.

Phase delay layer 62 consists of a birefringent material, for example a nematic liquid crystal material. The layer thickness of phase delay layer 62 is typically selected such that its phase delay corresponds to an optical retardation between about $\lambda/6$ and about $\lambda/2$, preferably about $\lambda/4$, wherein $\lambda$ represents a wavelength in the range of the visible spectrum.

When security element 12 is viewed with normal, unpolarized light and without auxiliary means, areas 64 with phase delay layer 62 are practically imperceptible because the phase delay of layer 62 has the same effect for all polarization directions of the incident light, and its light absorption is insignificant.

But if security element 12 is instead viewed with a polarizer 70 placed on top of it, as shown in FIG. 6, differences in contrast between areas 64 that have the phase delay layer and areas 66 that do not have the phase delay layer become clearly visible. The presence and shape of the pattern formed by areas 64 may thus be used as a further authentication measure, for example at the point of sale or in banks.

The mode of operation of the hidden security feature will now be explained using the example of a $\lambda/4$ phase delay layer 62 and a circular polarizer 70 that transmits only right-circular polarized light. Under these conditions, only the right-circular polarized component of incident unpolarized light is passed through circular polarizer 70. In subzones 66 of the security element where phase delay layer 62 is not present, the right-circular polarized light is reflected by metallic reflection layer 26 in thin film element 24 with an opposite polarization direction, that is to say it is reflected as left circular polarized light. The reflected left circular polarized light is blocked by circular polarizer 70, and subzones 66 appear dark to the viewer.

On the other hand, in subzones 64 with the phase delay layer, the right-circular polarized light is converted into linearly polarized light by phase delay layer 62 before it is reflected on reflection layer 26. The unchanged linearly polarized light passes through phase delay layer 62 again and is converted to right circular polarized light, which passes under the selected conditions the circular polarizer 70 unobstructed. In subzones 64, the pattern of the open security feature appears thus with essentially unaltered brightness to the viewer.

In this context, the ability to combine the open and the hidden security element depends to a large degree on the fact that semitransparent ink layer 34, 54 largely preserves the polarization state of the light that passes through it. This ensures that the pattern created by phase delay layer 62 may be rendered equally visible in both the color-variable and the color-constant zones.

As in the embodiments described previously, the reflection layer and the absorber layer in the embodiment of FIGS. 5 and 6 may also be furnished with gaps, for example to create a metallic negative text or local transparent zones in an otherwise opaque security element.

In all described forms, the semitransparent ink layer may also include a plurality of subzones with different color impressions. The color impression of the thin film element may then be adapted to match the color impression of one or more subzones for one or even several predefined viewing conditions. For example, a thin film element for which the color impression changes from magenta to green when it is tilted may be combined with a semitransparent ink layer having two subzones, of which the first subzone appears magenta and second appears green. The color impression of the thin film element then essentially matches the color impression of the first subzone of the ink layer (magenta) when viewed perpendicularly, but when it is tilted, it essentially matches the color impression of the second subzone of the ink layer (green). This color change and the associated change in visual assignment may thus serve to make various design elements in the security element appear and/or disappear when the security element is tilted.

In all embodiments, the thin film elements may be created also in the form absorber layer/dielectric layer/absorber layer, and even larger layer stacks are possible with the sequence absorber layer 1/dielectric layer 1/absorber layer 2/dielectric layer 2 . . . dielectric layer N−1/absorber layer N, where N=3, 4, 5 . . . Layer sequences of such kind have a color shift effect too, but they are not opaque so the effect may also be viewed from the back of the security element. Security elements including thin film elements of such kind may particularly be used with documents that have see-through areas.

The gaps in the reflection layers described above may also be arranged in a grid pattern, preferably occupying a low proportion of the surface, 40% or less. The gaps in the reflection layers are then practically unnoticeable in incident light, but appear clearly in transmitted light.

The invention claimed is:

1. A security element for securing items of value, comprising a relief structure on which a thin film element having a color shift effect is disposed, wherein the thin film element comprises an absorber layer with gaps, in which no color shift effect is perceptible, and a semitransparent ink layer, which is disposed on top of the thin film element and the relief structure above the gaps in the absorber layer, wherein the color impression of the thin film element is coordinated with at least one subzone of the semitransparent ink layer when viewed under predefined viewing conditions, such that the color impressions appear very similar when viewed in a certain viewing direction, wherein the semitransparent ink layer has a light transmissivity between 30% and 95% in a spectral range in which the color impression of the thin film element is coordinated with the color impression of the semitransparent layer, and the thin film element contains either a reflection layer, an absorber layer and a dielectric spacer layer arranged between the reflection layer and the absorber layer, or at least a first absorber layer, a second absorber layer, and a dielectric spacer layer arranged between the two absorber layers.

2. The security element as recited in claim 1, characterized in that the semitransparent ink layer completely fills the area of the gaps in the absorber layer.

3. The security element as recited in claim 1, characterized in that the semitransparent ink layer only partially fills the area of the gaps in the absorber layer.

4. The security element as recited in claim 1, characterized in that the semitransparent ink layer is also present in areas of the absorber layer above the thin film element where no gaps are present.

5. The security element as recited in claim 1, characterized in that the semitransparent ink layer has a light transmissivity between 60% and 95% in a spectral range in which the color impression of the thin film element matches the color impression of the semitransparent layer.

6. The security element as recited in claim 1, characterized in that the semitransparent ink layer is imprinted.

7. The security element as recited in claim 1, characterized in that the gaps in the absorber layer are provided in the shape of characters, patterns or codes.

8. The security element as recited in claim 1, characterized in that the semitransparent ink layer is provided in the shape of characters, patterns or codes.

9. The security element as recited in claim 1, characterized in that the semitransparent ink layer includes a plurality of subzones with different color impressions, and when viewed under predefined conditions the color impression of the thin film element is coordinated with the color impression of at least one of the subzones.

10. The security element as recited in claim 1, characterized in that the thin film element contains a reflection layer, an absorber layer, and a dielectric spacer layer arranged between the reflection layer and the absorber layer, and that the reflection layer has gaps in the form of patterns, characters or codes that form transparent or translucent zoned in the thin film element.

11. The security element as recited in claim 1, characterized in that the relief structure forms a diffractive structure, such as a hologram, a holographic grating image, a hologram-like diffraction structure, or an achromatic structure such as a matte structure, a micromirror arrangement, a blazed grating with a sawtooth-like notched profile or a Fresnel lens arrangement.

12. The security element as recited in claim 1, characterized in that a transparent phase delay layer is arranged in areas over the thin film element, forming a phase-delaying layer for light in the visible wavelength range.

13. The security element as recited in claim 12, characterized in that the phase delay layer is provided in the form of patterns, characters, or a code.

14. The security element as recited in claim 12, characterized in that the phase delay of the phase delay layer corresponds to an optical retardation between $\lambda/6$ and $\lambda/2$ for light in the visible wavelength range.

15. The security element as recited in claim 12, characterized in that the phase delay layer forms a $\lambda/4$ layer for light in the visible wavelength range at least in subzones.

16. The security element as recited in claim 12, characterized in that the phase delay layer is formed from nematic liquid crystal material.

17. The security element as recited in claim 12, characterized in that the semitransparent ink layer essentially preserves the polarisation state of penetrating light in the visible wavelength range.

18. The security element as recited in claim 1, characterized in that the security element is a security thread, a security tape, a security strip, a patch or a label that can be attached to a security paper, value document, or the like.

19. A security paper for producing security or value documents such as banknotes, cheques, identity cards, certificates or the like, comprising—the security element in accordance with claim 1.

20. The security paper as recited in claim 19, characterized in that the security paper includes a carrier substrate made from paper or plastic.

21. A data carrier, particularly a branded item, value document or the like, having the security element in accordance with claim 1.

22. A method for producing a security element, comprising the steps in which an embossing lacquer layer is applied to a substrate and embossed in the form of a desired relief structure, a thin film element having a color shift effect is disposed on the relief structure, wherein the thin film element is formed either with a reflection layer, an absorber layer, and a dielectric spacer layer arranged between the reflection layer and the absorber layer, or with at least a first absorber layer, a second absorber layer, and a dielectric spacer layer arranged between the two absorber layers, and wherein an absorber layer of the thin film element is provided with gaps, in which no color shift is perceptible, a semitransparent ink layer is disposed on top of the thin film element and the relief structure above the gaps in the absorber layer, wherein the color impression of the thin film element is coordinated with the color impression of at least one subzone of the semitransparent ink layer when viewed under predefined conditions, so that the color impressions appear very similar when viewed from a certain viewing direction, and wherein the semitransparent ink layer is formed with a light transmissivity between 30% and 95% in a spectral range in which the color impression of the thin film element is coordinated with the color impression of the semitransparent layer.

23. The method as recited in claim 22, characterized in that the semitransparent ink layer is imprinted, particularly in a silkscreen, intaglio or flexographic printing process.

24. The method as recited in claim 22, characterized in that a transparent phase delay layer is arranged in areas over the thin film element, forming a phase-shifting layer for light in the visible wavelength range.

25. The method as recited in claim 24, characterized in that the phase delay layer is printed onto the thin film element and, if applicable, onto the ink layer.

26. The method as recited in claim 24, characterized in that the phase delay layer is applied to a carrier foil and is transferred to the thin film element having the applied ink layer.

* * * * *